US007325365B2

(12) United States Patent
Warner

(10) Patent No.: US 7,325,365 B2
(45) Date of Patent: Feb. 5, 2008

(54) WINDOW PROTECTION STRUCTURE

(76) Inventor: Jerald R. Warner, 787 Blvd. of Champions, Shalimar, FL (US) 32579

( * ) Notice: Subject to any disclaimer, the term of this patent is extended or adjusted under 35 U.S.C. 154(b) by 306 days.

(21) Appl. No.: 11/260,323

(22) Filed: Oct. 27, 2005

(65) Prior Publication Data

US 2007/0107327 A1 May 17, 2007

(51) Int. Cl.
*E06B 9/02* (2006.01)
*E06B 3/26* (2006.01)

(52) U.S. Cl. ..... 52/203; 52/202; 49/50; 49/57; 160/368.1

(58) Field of Classification Search ..... 52/202, 52/203; 49/50, 57, 62; 160/368.1
See application file for complete search history.

(56) References Cited

U.S. PATENT DOCUMENTS 607,707 A * 7/1898 Scharff ..... 52/37
2,975,491 A * 3/1961 Paul et al. ..... 52/202
3,237,778 A * 3/1966 Hoodis ..... 211/119.011
6,155,009 A * 12/2000 Pena ..... 52/202
6,205,713 B1 * 3/2001 Thompson et al. ..... 49/465
6,615,555 B2 * 9/2003 Madden ..... 52/202

FOREIGN PATENT DOCUMENTS

GB 2434311 * 7/2007

* cited by examiner

*Primary Examiner*—Robert Canfield
*Assistant Examiner*—Brent W Herring
(74) *Attorney, Agent, or Firm*—J. Ron Richebourg

(57) ABSTRACT

A window protection structure for a building including novel structure for affixing a sheet of protection material over the window opening. The sheet material is cut to the size of the window opening in the building, and holes are formed therein. U-shaped clips are slid onto an upper edge of the sheet material, and a plurality of brackets are provided with a pair of holes formed therein. Cords loops are secured through the holes in the brackets. The brackets are adapted for receipt by the interior of the window and the cords are threaded to the exterior of the window. The cord loops are threaded through the holes in the sheet material. A bungee cord is then used for securing the ends of the cord loops, whereby the sheet material is held firmly against the window.

18 Claims, 6 Drawing Sheets

WINDOW PROTECTION STRUCTURE

FIELD OF THE INVENTION

The present invention generally relates to the field of storm protection and in particular to a structure for rapidly and easily inserting window protection prior to a severe storm, such as a hurricane or the like.

BACKGROUND OF THE INVENTION

As has been witnessed lately by a series of hurricanes, buildings (including homes) may be damaged or destroyed by high winds and high waves. Debris can break windows and doors, allowing high winds inside the home. In extreme storms, such as hurricanes, the force of the wind alone can cause weak places in ones home to fail. Experts have done extensive examination after hurricanes and have found four areas that should be checked for weakness—the roof, windows, doors and garage doors. The invention disclosed hereinbelow addresses a structure that allows rapid installation of protection over windows or doors, which structure is also referred to herein as storm shutters.

Installing storm shutters over all exposed windows and other glass surfaces can be one of the easiest and most effective ways to protect one's home. The cost for storm shutters is very minor when compared with the cost for repairs or replacement of one's home Shutters should be installed to cover all windows, French doors, sliding glass doors and skylights. There are many types of manufactured storm shutters available.

Plywood shutters that you make yourself, if installed properly, can offer a high level of protection from flying debris during a hurricane. Plywood shutters can be installed on all types of homes. For installation, bolts, wood or masonry anchors, washers and ⅝-inch plywood exterior-grade plywood are typically used. However, such conventional installation procedures are time consuming and leave holes in the walls or window frames or sills. Such holes are especially problematic where the walls of the house are vinyl or stucco.

A more recent prior art device and technique is sold under the name Pylox Hurricane Window Clips. These clips slide onto the edge of a plywood sheet thereby allowing the sheet of plywood to be inserted into the exterior window casings of the home or business. The clips also allow installation and removal without the use of tools; however, these clips only work on brick, stone or concrete block structures. Moreover, if wind gets behind the window covering, such as a sheet of plywood, the protection could be compromised and come loose. What is needed is a window protection structure that can be cinched or bound tightly against the window.

SUMMARY OF THE INVENTION

As will be amplified in greater detail hereinbelow, the present invention solves one of the prior art problems by providing a structure that allows a simple and rapid method for protecting windows and doors prior to a severe storm, such as a hurricane.

Accordingly, it is an object of the present invention to provide a simplified structure for protecting windows or doors of buildings against damage from high velocity winds during severe storms or hurricanes.

Another object of the present invention is to provide a structure that is easy and simple to install over windows or doors prior to a severe storm or hurricane and one that cinches tightly against the window to be protected.

Still another object of the present invention is to provide a structure that does not require the drilling of holes into the hose siding or window casing.

Yet another object of the present invention is to provide an inexpensive structure that is useful with a variety of window protection materials and one that is compatible with any type of home siding.

A window protection structure is provided for a building the uses a novel structure for affixing a sheet of protection material over the window opening in the building. The sheet material is first cut to the size of the window opening in the building, and holes are then formed therein. Next, U-shaped clips are slid onto an upper edge of the sheet material, and a plurality of brackets are provided each having a pair of holes formed therein. Cord loops are secured through the holes in the brackets. The brackets are adapted for receipt by the interior of the window and the cords are threaded to the exterior of the window. The cord loops are threaded through the holes in the sheet material. A bungee cord is then used for securing the ends of the cord loops after being threaded through the holes in the sheet material, whereby the sheet material is held firmly against the window.

Still other objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which drawings form a part of this application.

DETAILED DESCRIPTION OF ONE EMBODIMENT

Figure 1A:
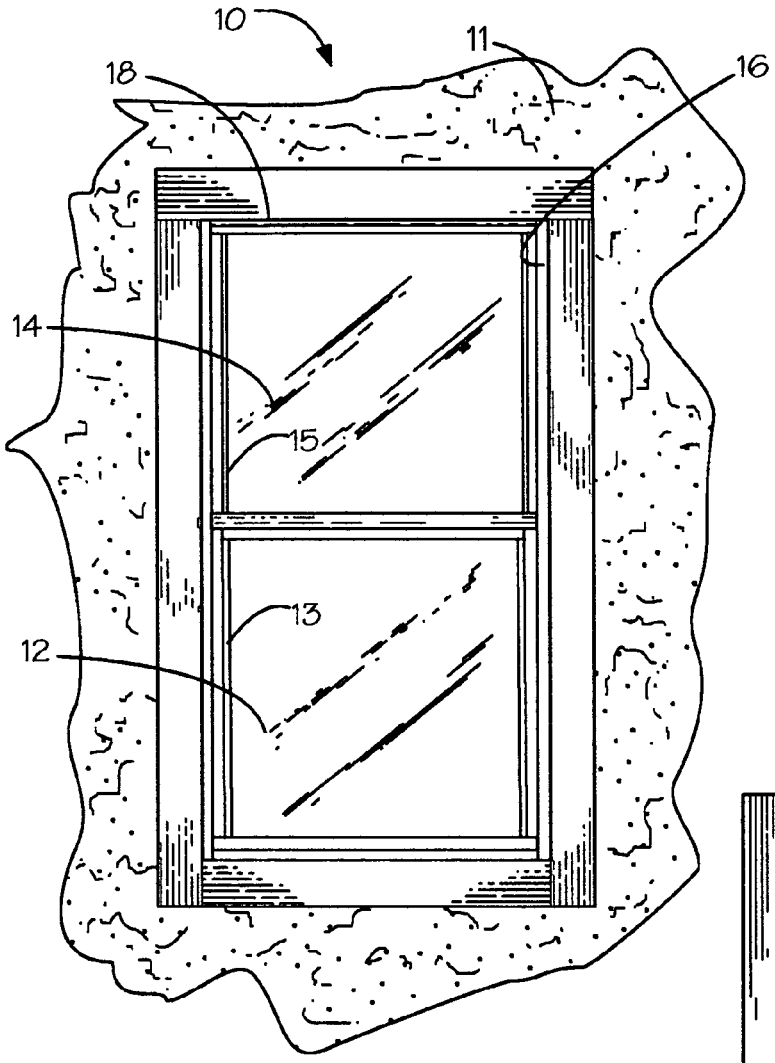
FIG. 1A is an elevation view of a typical window to be protected by the structure of the present invention.

Referring now to the drawings, and to FIG. 1A in particular, an elevation of a window 10 to be protected by the structure of the present invention is shown. In the illustrated embodiment, window 10 is a conventional single-hung window in a building 11 having a lower window pane 12 supported by a lower frame 13 and an upper window pane 14 supported by a frame 15. The building 11 also includes a frame 16 formed therein for receiving the window 10. The window 10 includes an outer frame 18 that fits within the frame 16 for supporting the slidable lower and upper window frames 13 and 15, respectively.

It is pointed out, however, that the present invention has applicability to other types of windows and doors and is not limited to the illustrated embodiment.

Figure 1B:
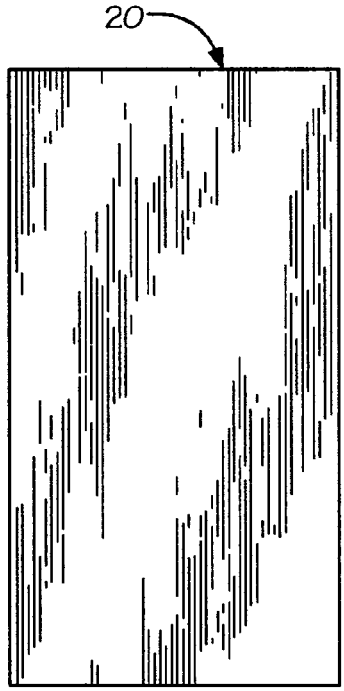
FIG. 1B is an elevation view of a window protector sheet cut to size before installation.

FIG. 1B illustrates an elevation view of sheet material 20, which in one embodiment may be ⅝ inch plywood. The sheet material 20 may also comprise steel, aluminum, plastic or corrugated steel, clear plastic or the like. The sheet material 20 is first cut to size in order to fit snugly within the fame 16 in the building 11.

Figure 2A:
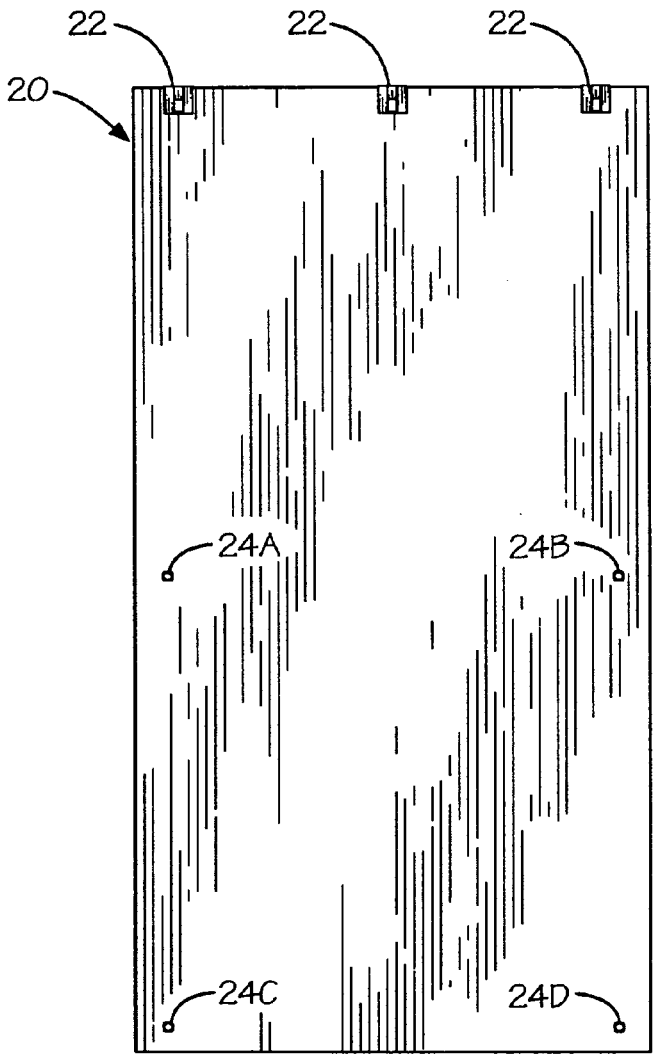
FIG. 2A is an elevation view of the window protector sheet after the addition of securing clips and the drilling of holes as required.
Figure 2B:
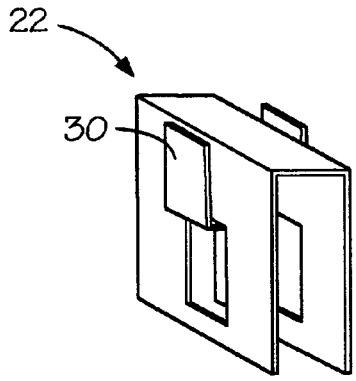
FIG. 2B is an isometric view of a clip used with the present invention.

Referring now to FIG. 2A, an elevation view illustrates the window protector sheet material 20 after the addition of securing clips 22 and the drilling of a plurality of holes 24A-24D as required. Continuing with the description of the illustrated embodiment, wherein window 10 is a single-hung window, two holes 24A and 24B are drilled near each edge approximately one-half way down the sheet material 20, or near the junction between the lower and upper window frames 13 and 15, respectively. Two additional holes 24C and 24D are drilled near the bottom corners of the sheet material 20. Next, clips 22 (which are illustrated in FIG. 2B) are slipped onto the top edge of the sheet material 20. The clips are formed into a U-shape (as seen in cross section), wherein the space between sides of the U are approximately the same size as the thickness of the sheet material 20. This space is ⅝ inch in the illustrated embodiment. The clips 22 include a clasp 30 attached to each side thereof. The purpose for the clasp 30 will be explained further hereinafter.

Figure 2C:
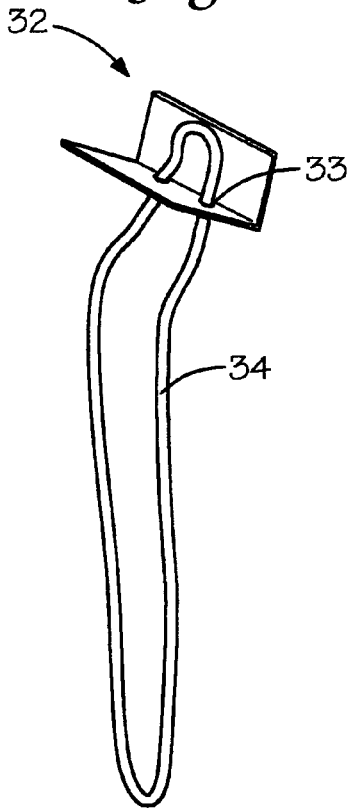
FIG. 2C is a perspective view of a window bracket and band in accordance with the present invention.

Referring now to FIG. 2C a bracket 32, which is preferably made of sheet metal material or durable plastic formed into an L shape in cross section. A pair of holes 33 is formed into one side of the bracket 32 for receiving a cord loop 34, which in accordance with one embodiment may comprise nylon parachute cord.

Figure 3A:
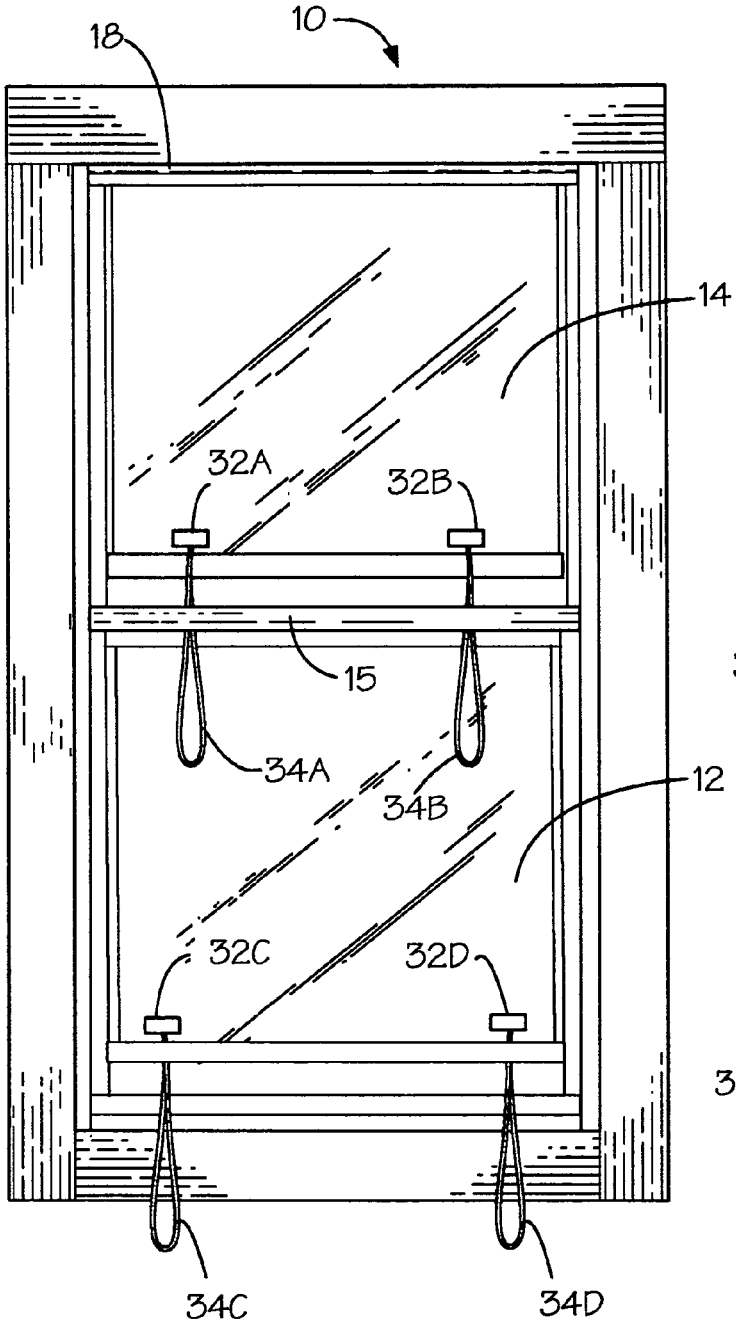
FIG. 3A is an elevation view of a window to be protected after securing the brackets with bands to the window itself.
Figure 3B:
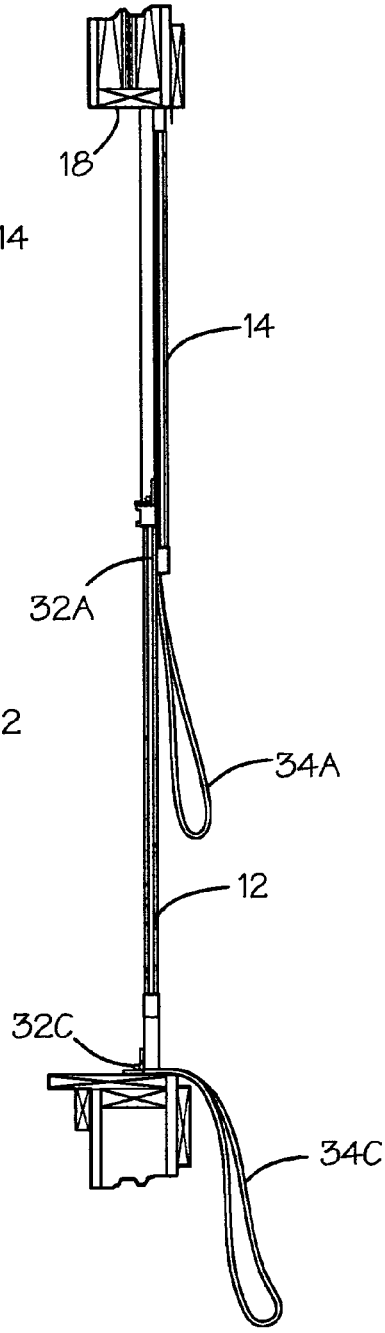
FIG. 3B is a cross-sectional view of the structure shown in FIG. 3A.

Referring now to FIGS. 3A and 3B, an elevation and cross-section view of a single-hung window 10 is shown, respectively. Four brackets 32A through 32D, with cord loops 34A-34D attached thereto, are placed as shown in the tracks 18 receiving the window frames 13 and 15 of the window 10. In particular, brackets 32A and 32B are placed at the junction between the lower and upper window frames 13 and 15, respectively. The cords 34A and 34B are threaded through the gap between the lower and upper window frames. In a similar manner, brackets 32C and 32*d* are placed at the bottom of the lower window frame. The cords 34C and 34D are threaded through the gap between the lower window frame 15 and the larger window frame 16. The window is then closed and the cords 34A-34D are disposed outside the house to form attachments to the sheet material 20. I have found that nylon cord, such as parachute cord, works very satisfactory for the cords 34A through 34D since it has very high tensile strength for a given diameter and can be compressed sufficiently to allow full window closure.

Figure 4A:
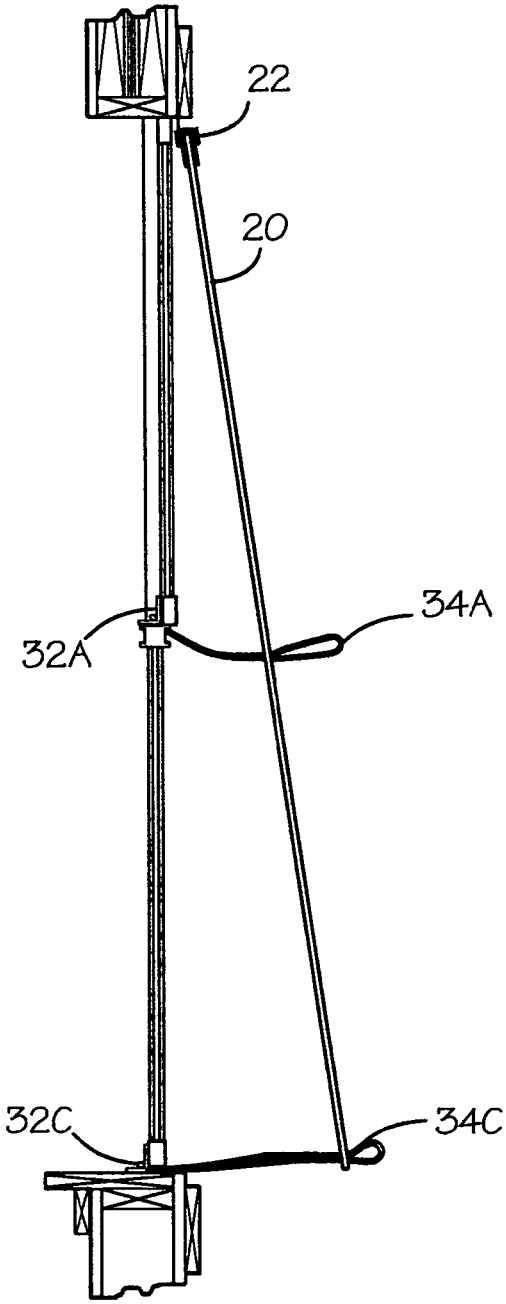
FIG. 4A is a cross-sectional view of the window and protector sheet being installed.
Figure 4B:
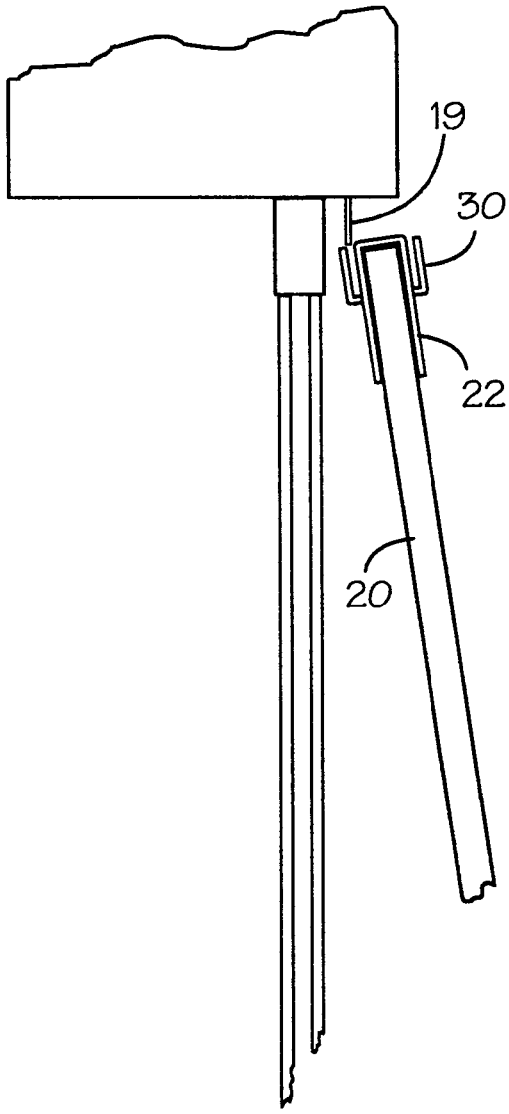
FIG. 4B is a detail of the structure shown in FIG. 4A.

Referring now to FIG. 4A a cross-sectional view of the window and protector during installation is shown. FIG. 4B illustrates more detail of one of the clips 22 as it is being inserted into the window frame 15. The bracket 30 is inserted into a drip edge 19 of the window frame 18. The cord loops 34 for the brackets 32A-32D are threaded through the holes 24A through 24D in the sheet material 20. Once the cord loops 34 are threaded through then the sheet material 20 is pushed into the window frame 16 and the cord loops are cinched together as shown in FIG. 5 by use of a cinch cord 41.

Figure 5:
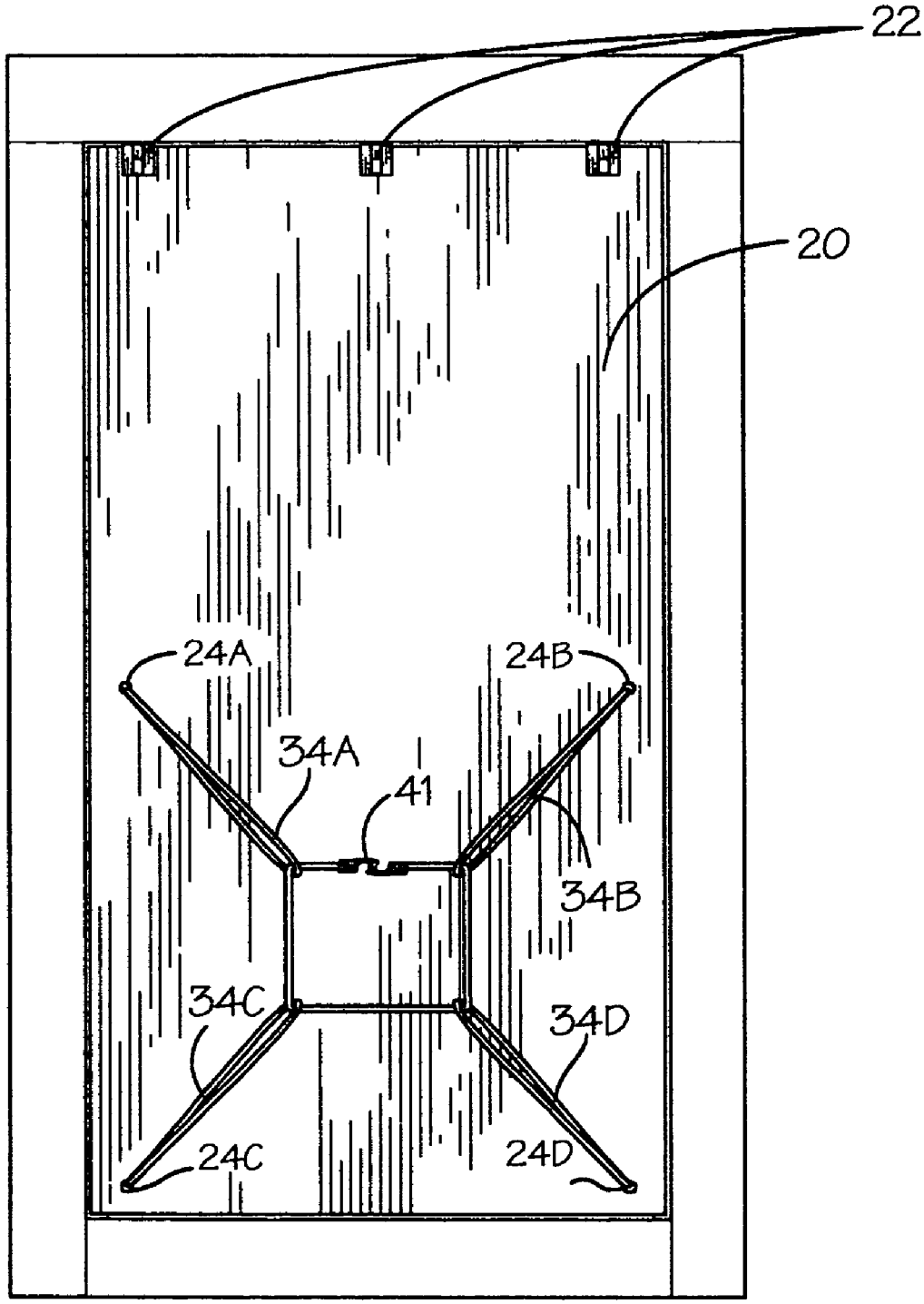
FIG. 5 is an elevational view of the structure once installed for protection of a window.

Referring now to FIG. 5 an elevational view illustrates the assembled structure and the use of a bungee cord (or the like) as the cinch cord 41, to tie together all ends of the cord loops 34A-34D, which were threaded through the holes 24A-24D, respectively. It is pointed out that any regular cord may suffice for use as the cinch cord 41.

Figure 6:
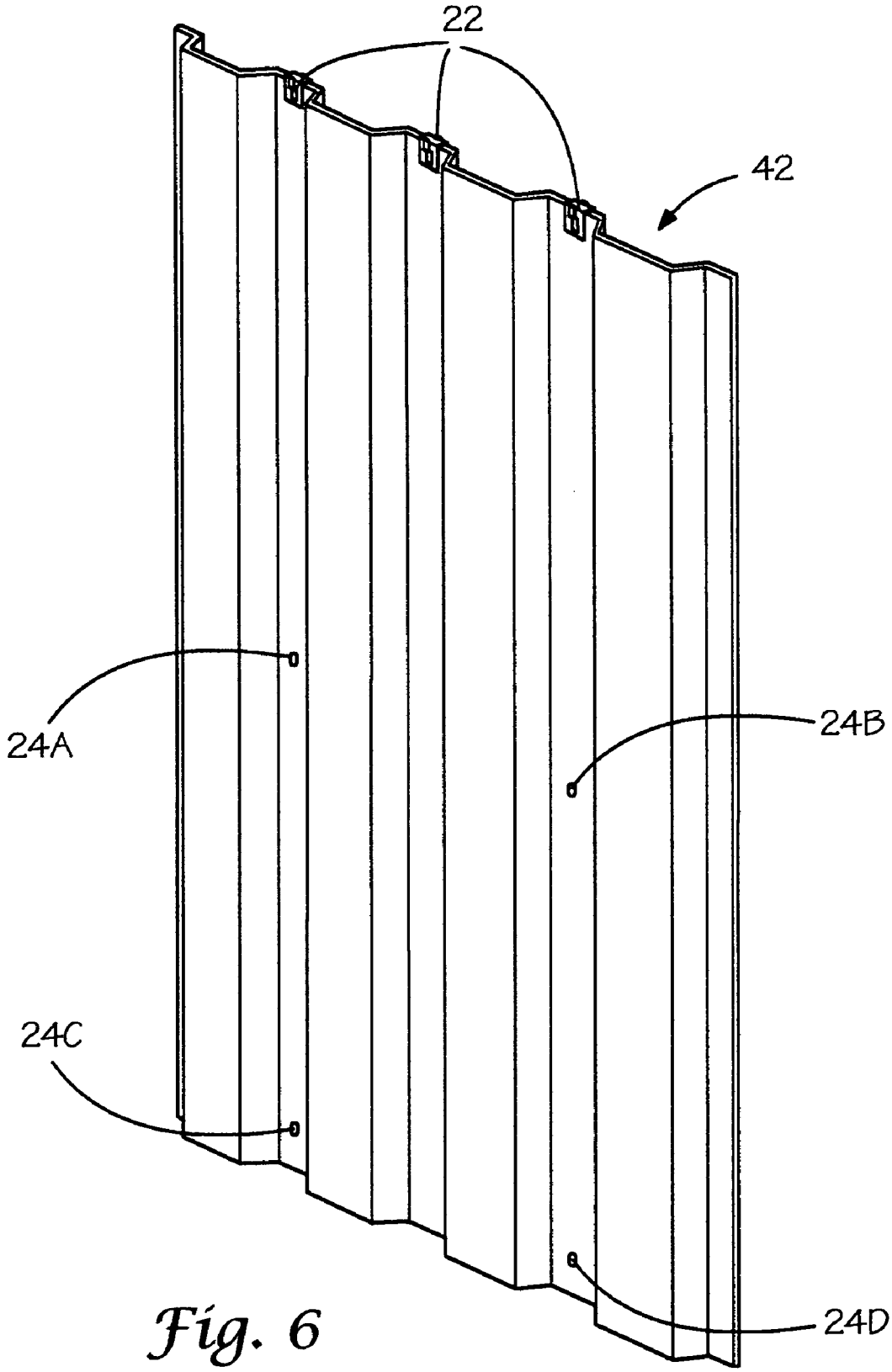
FIG. 6 is a perspective view of a sheet of corrugated material also useful with the present invention.

Other materials may used for the sheet material 20, such as see-through plastic or corrugated steel or plastic. FIG. 6 illustrates the use of such corrugated material 42 as the sheet material 20.

As stated hereinabove, the present invention has applicability to other types of windows and doors. In the case of a double-hung window, there would be no need to use the clips 22. One would simply drill more holes in the sheet material 20 near the top edge and add more cord loops 34 and brackets 32 for securing the upper end of the sheet material to the window in the same manner as described hereinabove. Also, in the case of a glass door one would do the same thing. That is, holes would be drilled around the periphery of the sheet material 20 and cord loops 34 and brackets 32 used around the periphery of the door with the cords loops 34 threaded through the holes in the sheet material. Thereafter, one or more cinch cords 41 would be used to secure the sheet material tightly against the door.

Although the invention has been described with reference to a specific embodiment, this description is not meant to be construed in a limiting sense. Various modifications of the disclosed embodiment as well as alternative embodiments of the invention will become apparent to one skilled in the art upon reference to the description of the invention. It is therefore contemplated that the appended claims will cover any such modifications of embodiments that fall within the true scope of the invention.

What is claimed is:

1. A window protection structure for a building comprising:

a. a sheet of protection material cut to size of the window opening in said building and having a plurality of holes formed therein;

b. a plurality of U-shaped clips adapted for sliding onto an upper edge of said sheet material;

c. a plurality of brackets having a pair of holes formed therein;

d. a plurality of cords, each being threaded through said holes in said brackets and secured into loops, said brackets being adapted for receipt by the interior of said window and said cords being threaded to the exterior of said window; and, e. a cinch cord for securing the ends of said cord loops after being threaded through said holes in said sheet material, whereby said sheet material is held firmly against said window.

2. A window protection structure as in claim 1 wherein said sheet of protection material is plywood.

3. A window protection structure as in claim 1 wherein said sheet of protection material is corrugated steel.

4. A window protection structure as in claim 1 wherein said sheet of protection material is clear plastic.

5. A window protection structure as in claim 1 wherein said U-shaped clips include a clasp attached to a side thereof and being disposed for engaging a drip-edge lip of said window during installation of said structure.

6. A window protection structure as in claim 1 wherein said brackets are made of aluminum.

7. A window protection structure as in claim 1 wherein said cords are made of nylon.

8. A window protection structure as in claim 1 wherein said cinch cord is a bungee cord.

9. An improved structure attaching a sheet of protection material to a window or door comprising:

a. a plurality of U-shaped clips adapted for sliding onto an upper edge of said sheet material;

b. a plurality of L-shaped brackets having a pair of holes formed therein;

c. a plurality of cords, each being threaded through said holes in said L-shaped brackets and secured into loops, said brackets being adapted for receipt by the interior of said window and said cords being threaded to the exterior of said window; and, d. a cinch cord for securing the ends of said cord loops after being threaded through holes formed in said sheet material, whereby said sheet material is held firmly against said window.

10. A window protection structure as in claim 9 wherein said U-shaped clips include a clasp attached to a side thereof and being disposed for engaging a drip-edge lip of said window during installation of said structure.

11. A window protection structure as in claim 9 wherein said brackets are made of aluminum.

12. A window protection structure as in claim 9 wherein said cords are made of nylon.

13. A window protection structure as in claim 9 wherein said cinch cord is a bungee cord.

14. A structure for attaching a sheet of protection material to a window or door comprising:

a. a plurality of L-shaped brackets having a pair of holes formed therein;

b. a plurality of cords, each being threaded through said holes in said L-shaped brackets and secured into loops, said brackets being adapted for receipt by the interior of said window and said cords being threaded to the exterior of said window; and, c. a cinch cord for securing the ends of said cord loops after being threaded through holes formed in said sheet material, whereby said sheet material is held firmly against said window.

15. A window protection structure as in claim 14 wherein said brackets are made of aluminum.

16. A window protection structure as in claim 14 wherein said brackets are made of plastic.

17. A window protection structure as in claim 14 wherein said cords are made of nylon.

18. A window protection structure as in claim 14 wherein said cinch cord is a bungee cord.

* * * * *